United States Patent [19]

Prescott

[11] Patent Number: 4,784,532

[45] Date of Patent: Nov. 15, 1988

[54] MINE ROOF SUPPORTS

[75] Inventor: Kenneth D. Prescott, Leigh, England

[73] Assignee: Gullick Dobson Limited, Lancashire, England

[21] Appl. No.: 63,945

[22] Filed: Jun. 19, 1987

[30] Foreign Application Priority Data

Jun. 26, 1986 [GB] United Kingdom ..... 8615666

[51] Int. Cl.[4] ..... E21D 17/05

[52] U.S. Cl. ..... 405/296; 405/291

[58] Field of Search ..... 405/294, 295, 296, 291, 405/292, 297; 299/32; 91/170 MP

[56] References Cited

U.S. PATENT DOCUMENTS

| | | | |
|---|---|---|---|
| 3,872,678 | 3/1975 | Shuttleworth | 405/296 X |
| 3,889,475 | 6/1975 | Allen | 405/296 X |

FOREIGN PATENT DOCUMENTS

| | | | |
|---|---|---|---|
| 3019697 | 12/1981 | Fed. Rep. of Germany | 405/294 |
| 0723173 | 3/1980 | U.S.S.R. | 405/294 |
| 977352 | 12/1964 | United Kingdom . | |
| 1139988 | 1/1969 | United Kingdom . | |
| 1332636 | 10/1973 | United Kingdom . | |
| 1364221 | 8/1974 | United Kingdom . | |
| 1414257 | 11/1975 | United Kingdom . | |
| 1429799 | 3/1976 | United Kingdom | 405/294 |
| 2006864 | 5/1979 | United Kingdom . | |
| 1564964 | 4/1980 | United Kingdom . | |
| 2082236 | 3/1982 | United Kingdom . | |
| 2115048 | 9/1983 | United Kingdom . | |
| 2143271 | 2/1985 | United Kingdom . | |

*Primary Examiner*—Dennis L. Taylor

*Attorney, Agent, or Firm*—Armstrong, Nikaido, Marmelstein & Kubovcik

[57] ABSTRACT

A roof engaging structure for a mine roof support comprises at least two relatively movable roof engaging members 21 and 23, which are coupled together by at least two spaced-apart pivotal joints 25 and 26. The pivotal joints combine to influence the relationship of the roof engaging surfaces of the two members. In one embodiment for example, the roof engaging surfaces of the two roof engaging members may adopt either an angular or a parallel relationship with respect to one another, one surface lying at least partially below the adjacent surface. The arrangement enables the roof engaging structure to shape itself to various forms of mine roof, while preventing jack knifing of the forward end of the roof engaging structure.

5 Claims, 6 Drawing Sheets

24
23
34
33

32
31
22
21
30

MINE ROOF SUPPORTS

BACKGROUND TO THE INVENTION

The invention relates to mine roof supports.

In the underground mining of coal or like minerals by the longwall method of mining, a strip or web of mineral, for example coal, the thickness of the coal seam and up to 150 meters long is removed from the coal face by a mining machine traversing along the coal face. Because of the undulating nature of such seams, and the need to steer the machine within the seam to follow the undulations, steps are produced in the floor and the roof parallel to the direction of travel of the mining machine. If the steps are small, or the strata is friable, these steps are crushed and have no detrimental effect on the roof supporting function of the mine roof supports which are advanced sequentially behind the mining machine to support the newly exposed mine roof.

In a typical mine, the width of cut of removal of coal from the face may be 1 meter and the roof supporting structure of the mine roof support may be 3 meters long. It can thus be envisaged and demonstrated that the roof supporting structure bridges and contacts a series of steps in the roof in the roof supporting mode. Because the floor engaging structure of a mine roof support is usually shorter than the roof engaging structure the problems are not so acute and are therefore readily accommodated with conventional base structures.

DESCRIPTION OF THE PRIOR ART

In the roof engaging structure of conventional design the roof engaging structure is manufactured as either a single unit or two roof engaging parts hingedly connected each part being supported by hydraulic jack means or counterbalanced to assist in the control of a forward projecting cantilever part of the roof engaging structure.

One method of working coal seams by the longwall method is the immediate forward support (I.F.S.) system and to adopt this method involves the use of a cantilever part of the structure being extended by the width of the cut, for example 1 meter, thus resulting in a greater out-of-balance effect. In a two-part roof engaging structure, a condition known as jack-knifing can occur in which the forward end of the cantilever can drop to floor level, making it difficult to reset the support to the roof, because of the out-of-balance effect. The rate at which the forward end of the roof engaging structure descends, can also produce a dangerous environment for the miner or face workers.

Several attempts have been made to control the pivotal joint in a roof engaging structure, one being the application of a spring, for example a carriage-type spring across the joint, but this encroaches on the space beneath the joint, where the controls for the roof support are located, and the scheme has not therefore been widely adopted.

OBJECT OF THE INVENTION

It is an object of the invention to provide a flexible roof supporting structure suitable for a mine roof support without the possibility of the structure jack-knifing.

SUMMARY OF THE INVENTION

The invention provides a roof engaging structure for a mine roof support comprising at least two relatively movable roof engaging members which are coupled together by at least two spaced-apart pivotal joints, the pivotal joints combining to influence the relationship of the roof engaging surfaces of the two members.

Preferably the two roof engaging members are coupled by means having parallel axes, which pass through both member.

Preferably the arrangement allows the roof engaging surfaces of the two roof engaging members to move into either an angular, or alternatively, a parallel relationship, resulting in one surface or part thereof lying below or partially below the roof engaging surface of an adjacent roof engaging member.

One roof engaging member may carry a fixed pivot or hinge pin, the mating roof engaging member having radial or linear clearance to allow movement in at least one direction relative to the fixed pivotal hinge pin.

The roof engaging structure may be supported on one or more hydraulic jack means, and in a preferred embodiment, each roof engaging member may be supported by its own jack means.

Where the total roof engaging structure is supported by two spaced-apart jack means, at least one pivot point may be located therebetween, and generally both pivot points will lie between the jack means of a mine roof supports.

The invention includes a mine roof support having a roof engaging structure as defined above.

Other objects and advantages of the invention will become apparent from the following description of an embodiment of the invention, given by way of example.

DESCRIPTION OF AN EMBODIMENT OF THE INVENTION

Figure 1:
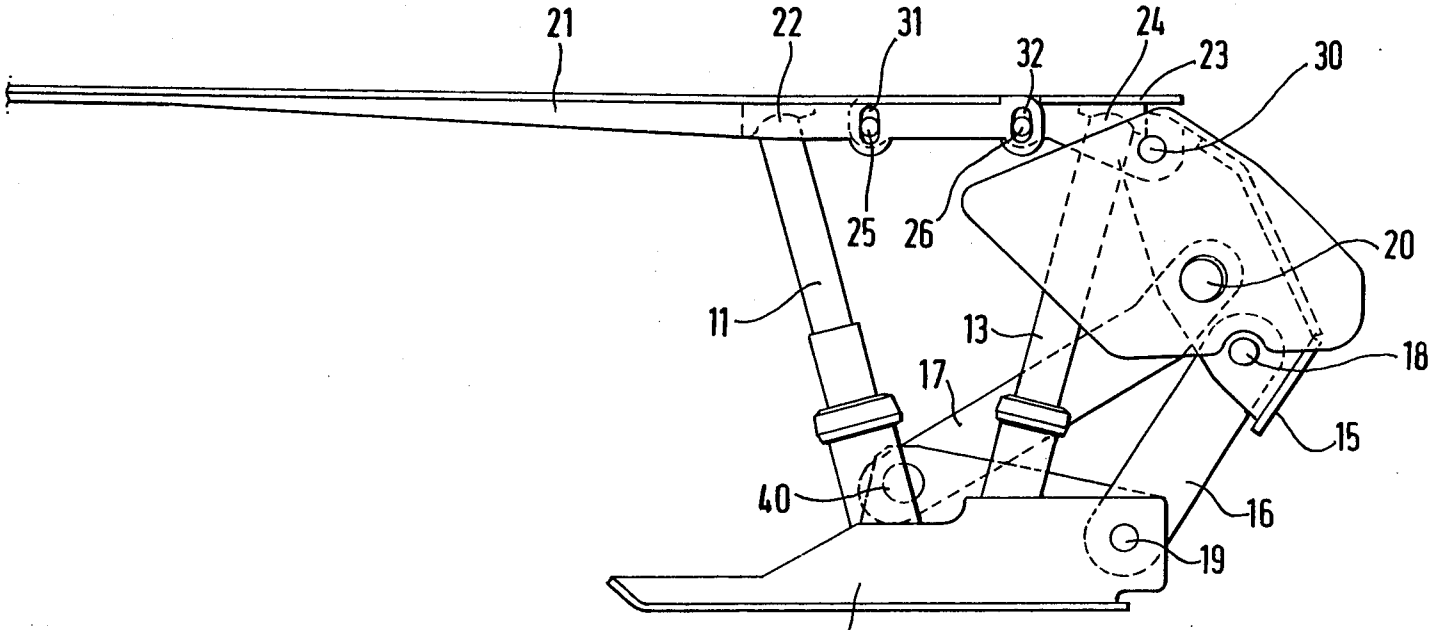
FIG. 1 is a side view of an embodiment of hydraulic roof support according to the invention, in its fully extended position.

Referring firstly to FIG. 1, a mine roof support is shown having a base 10 of generally conventional form, comprising two spaced-apart pontoon type members joined together by a bridge or like member (not shown).

On the base 10, there is a first pair of hydraulic forward jacks 11, 12 at the forward end, and a second pair of rear hydraulic jacks 13, 14 at the rear end. These jacks may be double acting as shown, or single acting, as desired. The base 10 is linked to a rear shield 15, by two lower links 16, and a central control upper link 17. Links 16 have upper pivots 18 and lower pivots 19. Link 17 has an upper pivot 20 and a lower pivot 40.

The roof engaging structure of the mine roof support comprises a canopy having a forward part 21 engaging at 22 to a spherical engaging structure of the forward jacks 11, 12. The canopy also has a rear part 23 located on the rear jacks 13, 14 by means of a spherical seating 24. Parts 21 and 23 are pivotally interconnected by pins 25 and 26.

Figure 2:
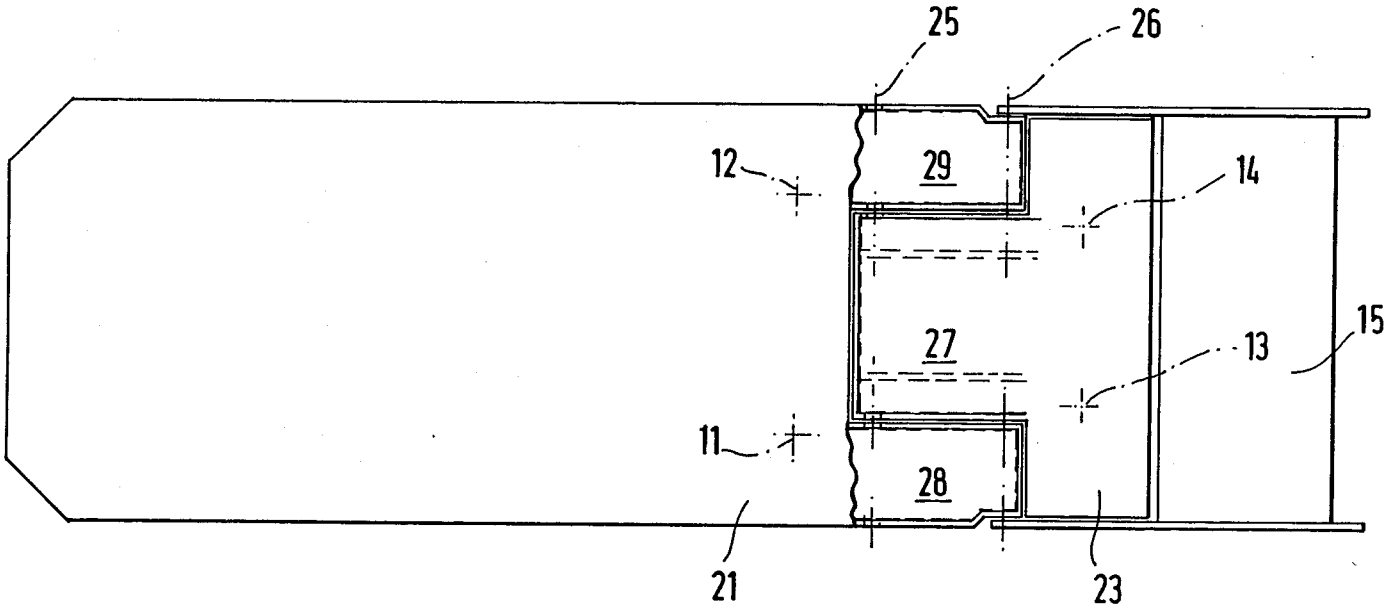
FIG. 2 is a plan view of the support shown in FIG. 1.

From FIG. 2, it can be seen that a projecting portion 27 of the rear member 23 is located between arms 28 and 29 of the forward member 21, the pins 25 and 26 passing through the parts 27,28 and 29.

The shield 15 and rear part 23 of the canopy are pivotally connected at 30.

Each pin 25 and 26 engages in a vertically extending slot 31 and 32. This gives the parts 21 and 23 a certain amount of independent relative movement, whilst eliminating the possibility of the part 21 jack-knifing to contact the floor of a mine.

Figures 3, 3A, 3B:
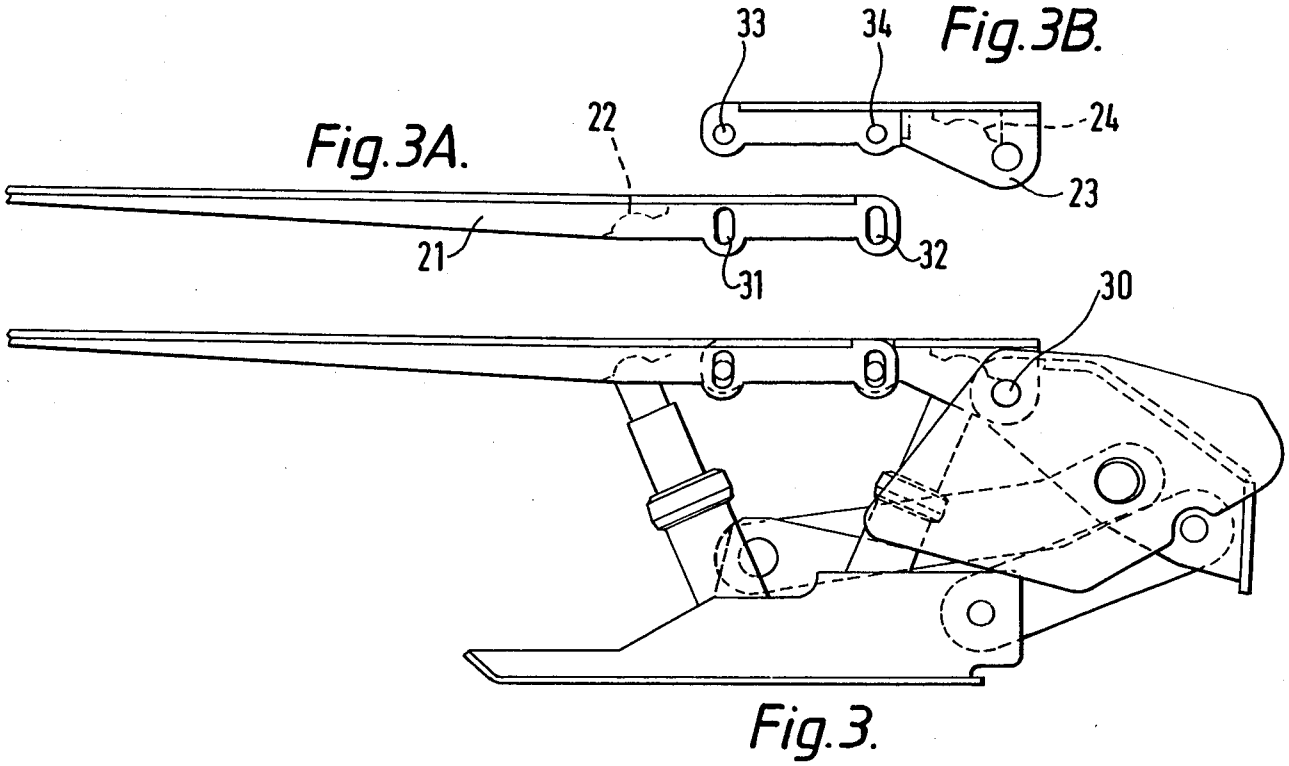
FIG. 3 shows the support in a mid position with only the first stage of its hydraulic jacks extended.
FIGS. 3A and 3B are respectively side views of the mating parts of the roof engaging structure.
Figure 4:
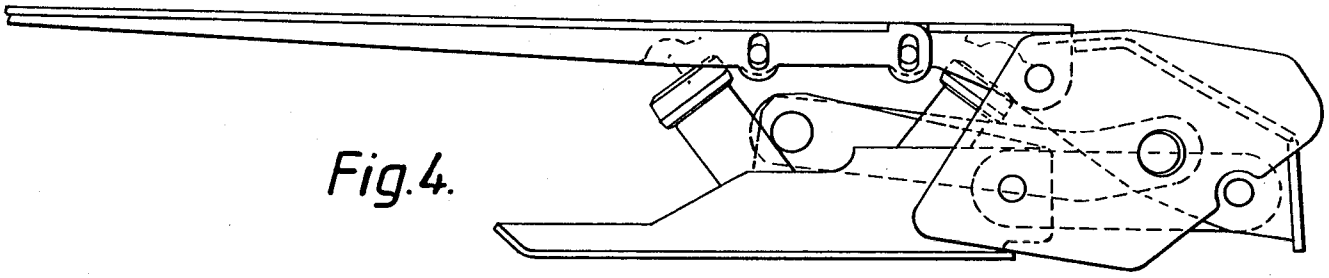
FIG. 4 is a side view showing the support in its fully closed position.

The form of connection will be better understood from a study of FIGS. 3A and 3B, from which it can be seen that the part 21 contains the elongated slots 31 and 32 while the part 23 has holes 33 and 34 in which the pins 25 and 26 are retained.

Figure 5:
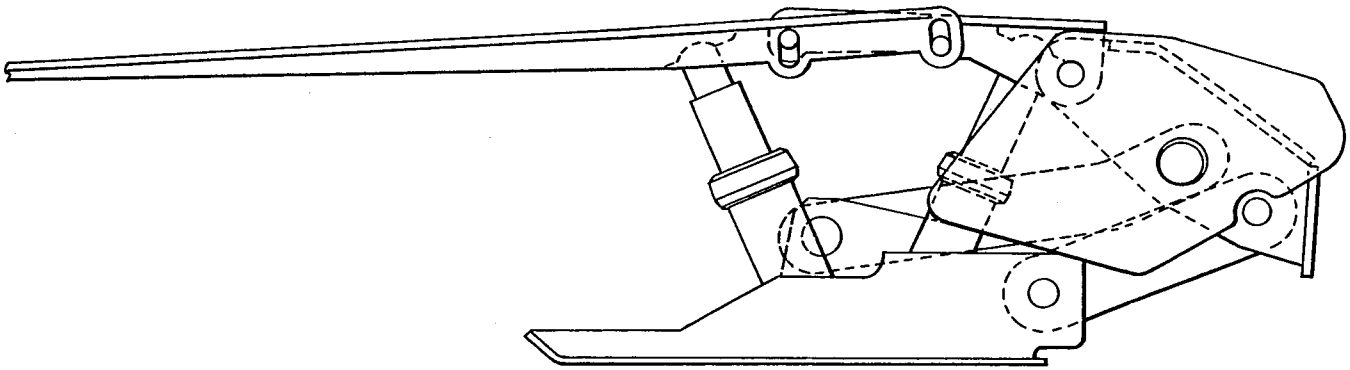
FIG. 5 shows the hydraulic mine roof support with the roof engaging structure in convex condition.
Figure 7:
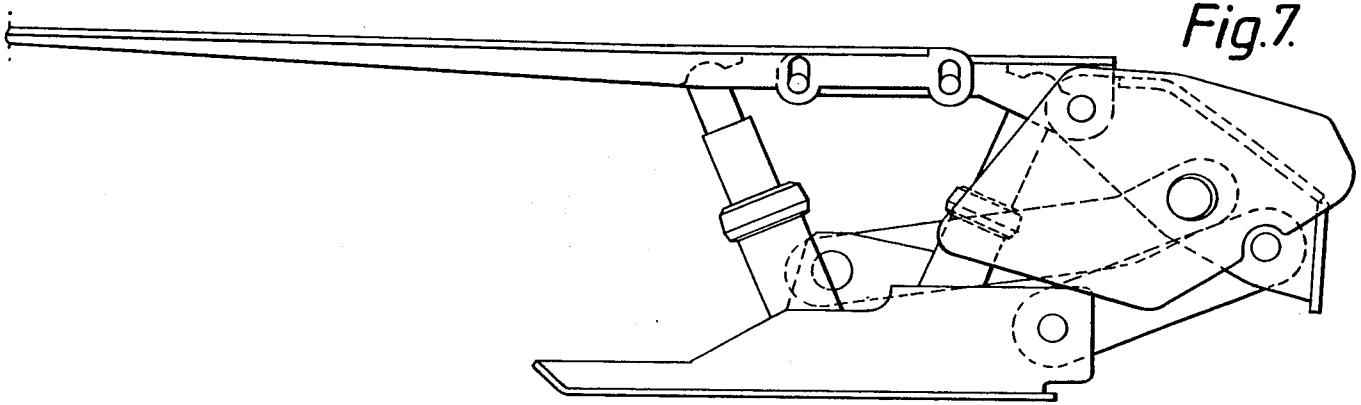
FIGS. 7 and 8 show the mine roof support with its roof engaging structure in two alternative parallel modes where one surface lies parallel but above the adjacent surface.
Figure 8:
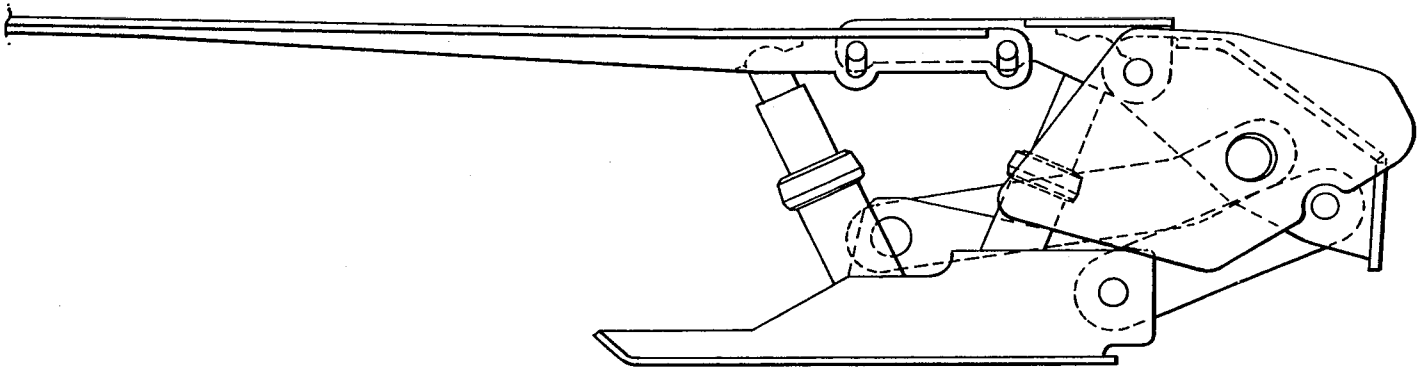

When the mine roof support is in use, and it is lowered from its roof supporting condition, the support will adopt the attitude shown in FIG. 5, because of the out-of-balance effect of the part 21, which takes the form of a cantilever. However, when the support is reset to engage a mine roof, the load applied by the roof will re-align the roof engaging structure to make best contact with the mine roof. If there has been a fall of roof material at either front or rear, thus providing a central portion of the roof which is lower than the front and rear portions of the roof, then the roof engaging structure can take up the concave position shown in FIG. 6. If on the other hand, if the mine roof has a step, resulting in a front portion which is higher than a rear portion, then the roof engaging structure may take up the attitude shown in FIG. 7. Yet another possibility is that the mine roof may have a front step which is lower than the rear portion, in which the roof engaging structure is free to adopt the attitude shown in FIG. 8.

Thus no part of the roof engaging structure may be set in fresh air, and the roof engaging structure is capable of a controlled amount of pivotal or bodily linear adjustment, without any possibility of jack-knife occurring.

Figure 6:
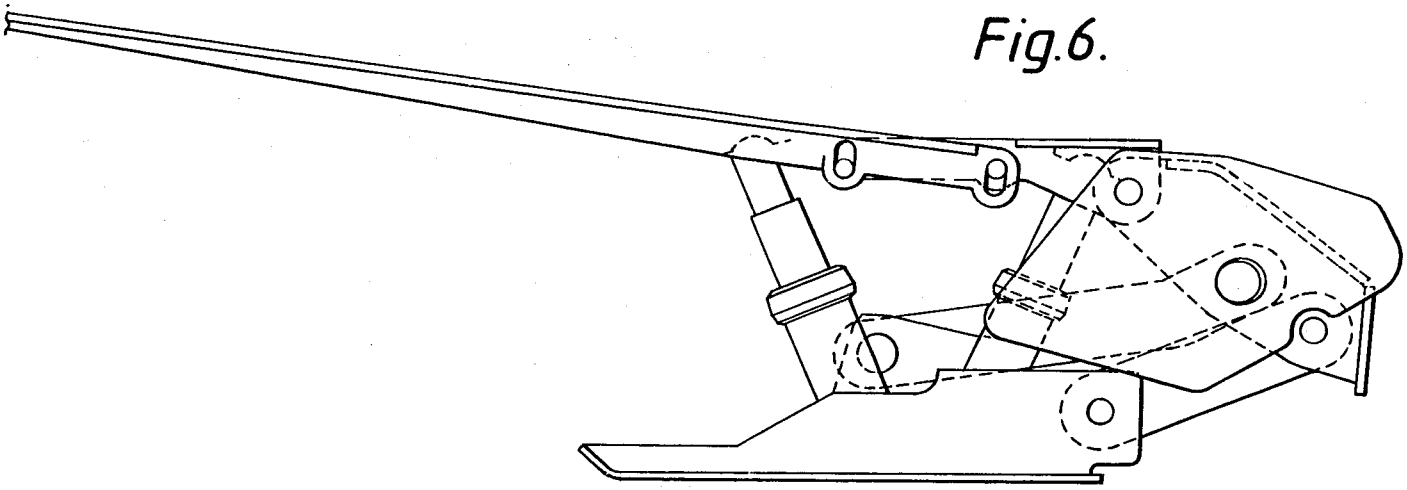
FIG. 6 shows the mine roof support with its roof engaging structure in a concave condition.

In other words, because of the limited movement of the pins 25 and 26 in the slots 31 and 32, excessive movement is not possible and if there are any circumstances which tend to produce excessive movement, the canopy joint locks either in the position shown in FIG. 5 or the position shown in FIG. 6.

The invention is not restricted to the details of the foregoing embodiment.

I claim:

1. A mine roof support, comprising:

a mine floor engaging base;

an inclined rear shield;

linkage means for pivotally connecting said inclined rear shield and said base;

a mine roof engaging canopy pivotally connected to said inclined rear shield, said canopy having a front and a rear and a longitudinal axis extending between said front and rear, said canopy including first and second canopy parts each having a mine roof contacting upper surface;

at least two spaced-apart pivotal connecting means for connecting said first and second canopy parts together for relative movement, said at least two spaced-apart pivotal connecting means each having a pivotal axis, said pivotal axes extending parallel each other and transversely to said longitudinal axis, said at least two spaced-apart pivotal connecting means permitting relative rotational movement of said first and second canopy parts about said pivotal axes and relative linear movement in an upward direction transverse to said pivotal axes;

first hydraulic jack means extending from said base to said first canopy part;

second hydraulic jack means extending from said base to said second canopy part;

said first and second canopy parts being movable relative to each other about said at least two spaced-apart pivotal connecting means between a first configuration in which said roof contacting surfaces of said first and second canopy parts are substantially coplanar with each other for contacting a substantially planar mine roof, a second configuration in which said roof contacting surfaces of said first and second canopy parts from an obtuse angle between each other for contacting a convex mine roof, a third configuration in which said roof contacting surfaces are downwardly inclined with respect to each other for contacting a concave mine roof, a fourth configuration in which said roof contacting surface of said first canopy part is downwardly stepped with respect to said roof contacting surface of said second canopy part for contacting a correspondingly stepped mine roof, and a fifth configuration in which said roof contacting surface of said first canopy part is upwardly stepped with respect to said roof contacting surface of said second canopy part for contacting a correspondingly stepped mine roof.

2. A mine roof support as claimed in claim 1, wherein said parallel pivotal axes extend through both first and second canopy parts.

3. A mine roof support as claimed in claim 1, in which one of said first and second canopy parts carries a fixed pivot member, the other of said first and second canopy parts having clearance to allow movement in at least one direction relative to said pivot member.

4. A mine roof support as claimed in claim 1, wherein at least one of said two spaced-apart pivotal connecting means is located between said first and second hydraulic jack means.

5. A mine roof support as claimed in claim 4, wherein both of said pivotal connecting means lie between said first and second hydraulic jack means.

* * * * *